United States Patent [19]

Benoit et al.

[11] 4,326,664

[45] Apr. 27, 1982

[54] THERMOPLASTIC BAGS HAVING STRESS RELIEF FEATURE AT HANDLE CONNECTION

[75] Inventors: Gordon L. Benoit, Macedon; Franz Bustin, Rochester; Jack J. Donaldson, Fairport, all of N.Y.

[73] Assignee: Mobil Oil Corporation, New York, N.Y.

[21] Appl. No.: 159,971

[22] Filed: Jun. 13, 1980

Related U.S. Application Data

[63] Continuation-in-part of Ser. No. 20,899, Mar. 15, 1979, abandoned.

[51] Int. Cl.[3] ..... B65D 33/06; B65D 33/02

[52] U.S. Cl. ..... 229/54 R; 229/55

[58] Field of Search ..... 229/54 R, 64, DIG. 3, 229/55; 150/12

[56] References Cited

U.S. PATENT DOCUMENTS

| | | | |
|---|---|---|---|
| 2,071,362 | 2/1937 | Rowe | 229/55 |
| 2,095,067 | 10/1937 | Kirk | 229/55 |
| 2,170,945 | 8/1939 | Greene | 229/55 |
| 2,213,290 | 9/1940 | Rowe | 229/55 X |
| 3,966,524 | 6/1976 | Lehmacher | 229/54 R |

*Primary Examiner*—Stephen P. Garbe

*Attorney, Agent, or Firm*—Charles A. Huggett; Michael G. Gilman; James P. O'Sullivan, Sr.

[57] ABSTRACT

A thermoplastic bag characterized by having handles formed on opposite ends of the bag mouth which is characterized by having structural features immediately adjacent the mouth of the bag to provide stress relief at those positions on the bag mouth where maximum stress is concentrated when such bags are being filled with product and eventually carried by the user. The stress redistribution feature is characterized by an area or areas, immediately adjacent the mouth portion of the bag and the base of the handle members, which are characterized by having a plurality of narrow pleats which are impressed into the bag structure by die members during formation of the individual bag.

11 Claims, 9 Drawing Figures

FIG. 1 (PRIOR ART)
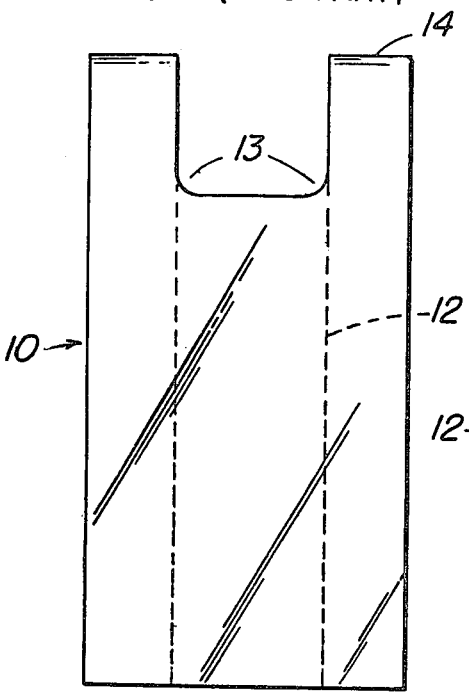
FIG. 2 (PRIOR ART)
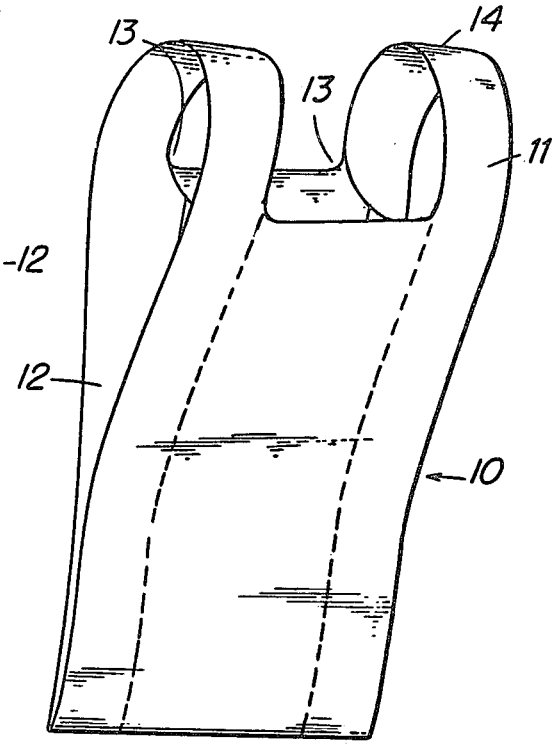
FIG. 3
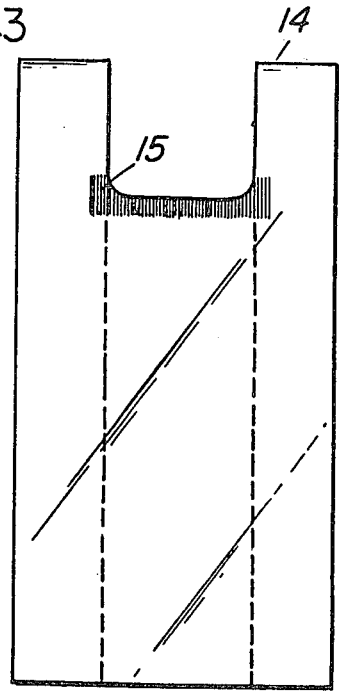
FIG. 4
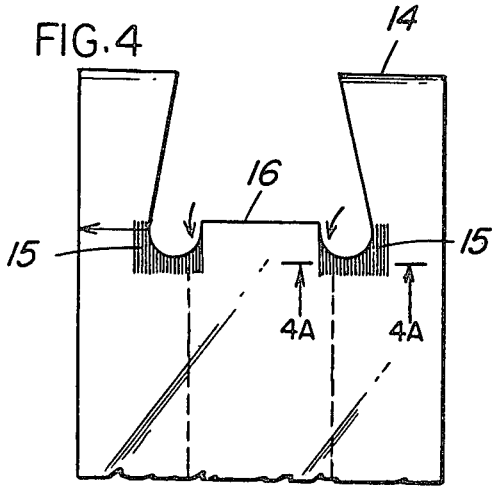
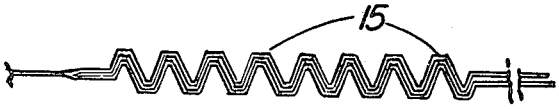
FIG. 4A FIG. 7
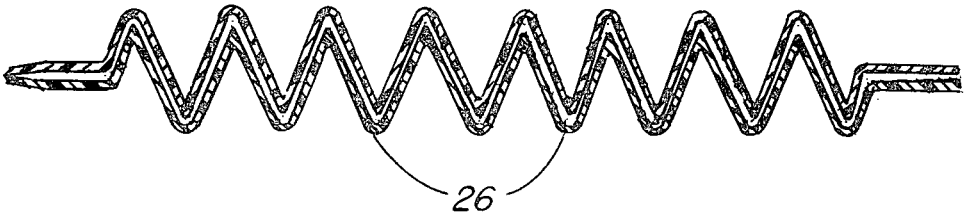
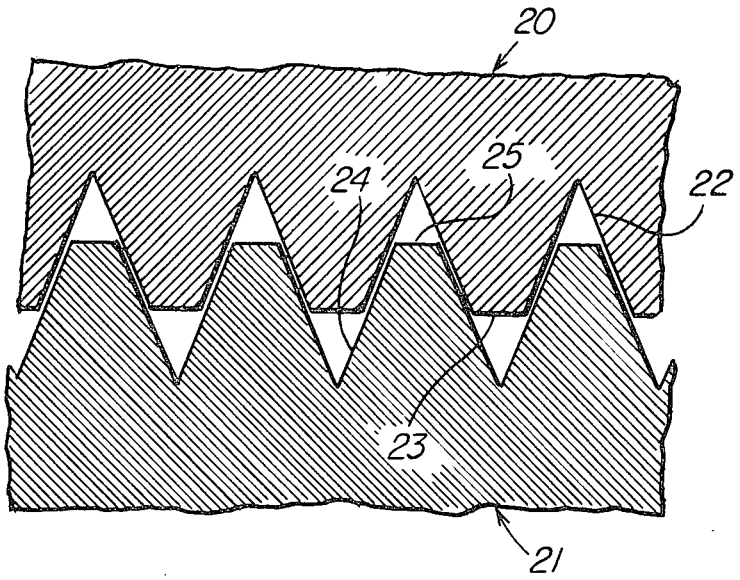
FIG. 8

THERMOPLASTIC BAGS HAVING STRESS RELIEF FEATURE AT HANDLE CONNECTION

CROSS-REFERENCE TO RELATED APPLICATIONS

This application is a continuation-in-part of U.S. Patent Application Ser. No. 020,899, filed Mar. 15, 1979 now abandoned.

BACKGROUND OF THE INVENTION

1. Field of the Invention

The present invention relates to handled thermoplastic bag structures which are especially designed to avoid stress concentration in those areas of the bag most susceptible to rupture such as a cut-edge which forms at the bag mouth or minute nicks and tears immediately adjacent to the bag mouth edge and caused as a result of separating forces developed in an individual bag along a perforate line, and during typical loading operations.

2. Description of the Prior Art

In the past, bags which were characterized by having carrying handles thereon were constructed using separate handle elements, distinct from the bag structure itself, which were fed for attachment adjacent to the open mouth portion of the bag. The manufacturing operation to produce such prior art structures with the separate process step of supplying handling element and applying them to the bag was quite cumbersome and uneconomical. More recently, however, bag structures have been developed, see for example U.S. Pat. Nos. 4,085,822; 3,352,411 and 3,180,557; the disclosures of which are incorporated herein by reference, wherein bags are formed so that the handle carrying elements are formed as an integral part of the bag structure itself, that is to say, the handles are actually an extension of the bag proper. An example of such a bag structure is one that is constructed from a flattened tube or a flattened side edge gusseted tube. A flattened portion of such a tube is cut off and sealed along its top and bottom edges. Conversely, such a bag may be formed by folding a piece of the thermoplastic material on itself, the bottom fold line constituting the bottom part of the bag and heat sealing the upper edge and side wall parts of the bag together. Next, a U shaped cutout is made in the upper portion of the bag to provide an opening or entrance for the introduction of goods to be packaged. The opposite edges of the upper portion of the bag structure immediately adjacent to the cutout area form loops which may be used to carry such bag structures when they are loaded. In the case of a gusseted tube such handle loops are reinforced, i.e., double ply thickness, by virtue of the presence of the re-entrant or gusset fold in the loop handle members.

Such aforedescribed prior art structure presents structural failure problems in those areas of the bag structure which are most susceptible to stress concentration when the handle loops of the bag are separated and temporarily suspended on a loading fixture for bag filling operations. One such filling operation and bag support structure are described in U.S. Pat. No. 4,062,170, the entire disclosure of which is incorporated herein by reference.

Such areas of stress concentration are usually located at areas adjacent to the lower portion of the bag handles. Additionally, it has been found when such bag structures are fabricated from high density polyethylene film there is a very pronounced tendency for tears to be initiated along the edge of cutout portions formed during cutting operations as the bag mouth is being produced. Such tears are usually in the machine direction of the film, i.e., in the direction in which the film is originally extruded and which usually corresponds, in the present instance, to the lengthwise direction of the bag, that is, from the bag top to the bag bottom. Such tears, once initiated, quickly propagate in the machine direction resulting in a bag failure.

SUMMARY OF THE INVENTION

The bag structure of the present invention eliminates or substantially reduces the severity of the structural deficiencies of the prior art bags discussed hereinabove. The present bag structures are provided with an increased amount of thermoplastic material surface area in that area of the lower handle region which is most susceptible to tearing, i.e., in an area immediately adjacent the open mouth portion of the bag and adjacent the individual bottom portions of the bag carrying handles. A particularly suitable technique for increasing the surface area of the bags in this region comprises impressing the film material in that area between matched forming dies or rollers to produce accordian pleats in that area of the bag mouth. Such an arrangement of pleats causes stresses encountered during bag loading operations to be redistributed to an area immediately below the mouth edge of the bag due to the increased path length along the edge of the bag relative to the film immediately below the pleated region. The stress is redistributed away from the bag mouth edge which, as hereinbefore discussed, is most susceptible to tearing during such loading operations.

Accordingly, the present invention provides a means for removing concentrated stresses from the mouth portion of a handle bag adjacent the cut out edge of the mouth and lower handle portions. Tearing of the individual bag in the machine direction, a direction in which linear polymers are most apt to tear, is either eliminated as a failure mechanism or is substantially reduced during bag loading operations. This is accomplished by permanently cold drawing the film locally in the lower cut out region of the bag in a transverse direction. This is accomplished by impressing a pleated section in that area of the bag by causing the film to be cold drawn into a pleated configuration utilizing a mechanical molding technique. This pleated section of film along the bag mouth edge is stretched 10 to 400 percent and is therefore 1.1 up to 4 times longer than the adjacent film in the interior of the bag just below the pleated area. As the pleated bag is stretched over a loading fixture, the shortest path length for the applied stress to follow is along the interior section of the bag directly below the pleating. Since, obviously, in this area there is a complete absence of nicks or irregularities, initiated edge tearing of film as a failure mechanism in this area is quite remote when normal bag-loading stresses are applied. The pleat lengths may suitably extend downwardly from the bag mouth about 0.5 inch to about 1.0 inch.

In accordance with the method of the present application, the thermoplastic bags are made by forming a thermoplastic tube having openings at each ends thereof and front and rear walls. The openings are sealed, and a plurality of pleats are formed in the front and rear walls such that the pleats extend toward the sealed openings. Waste portions of each of the front and rear walls are then removed. Such waste portions include an intermediate portion of one of the sealed ends and also portions of the pleats to form a pair of spaced handle members and a mouth portion between the handle members. Removal of the portion of the pleats with the waste portions insures that the pleats extend to the edges of the mouth portion.

BRIEF DESCRIPTION OF THE DRAWINGS

FIG. 1 is an overhead planar view of a prior art handle bag structure.

FIG. 2 is a perspective view of the bag shown in FIG. 1 in a partly opened condition.

FIG. 3 is an overhead planar view of one embodiment of the bag structure of the present invention.

FIG. 4 is an overhead planar view of an alternative embodiment of the bag structure of the present invention.

FIG. 4A is a cross-sectional view, on an enlarged scale, taken on line 4A—4A of FIG. 4.

FIG. 7 is a cross-sectional view, on an enlarged scale, taken on line 4A—4A of FIG. 4 of another embodiment.

FIG. 8 is a cross-sectional view of a pair of maturing rollers.

DESCRIPTION OF SPECIFIC EMBODIMENTS

In accordance with certain specific embodiments of the present invention thermoplastic bags having carrying handles integrally formed thereon are provided with areas which will offer stress relief when such bags are being loaded with items, such as groceries for example. In grocery loading operations such handle bags are suspended by their handles in an open position for loading after an individual bag has been removed from a pack of such bags. One such apparatus for suspending bags as hereinbefore noted is disclosed in U.S. Pat. No. 4,062,170. The individual bag handles, at spaced apart locations, are stretched around handle retaining members to maintain the bag in an open condition for loading. When such bags are stretched and suspended in such a fashion, a maximum amount of material stress as a result of stretching and loading tends to become concentrated at the base of the individual handle members and adjacent the open bag mouth. When certain polymers are employed to manufacture such bags, there is a pronounced tendency for the bag to tear as it is being loaded with items. Particularly susceptible to such tearing are bags fabricated from polymers which exhibit a high modulus or stiffness and low machine direction tear strength. Such polymers include polyolefins, such as high density polyethylene, polypropylene and the like. The situation becomes even more aggravated since the bag mouth is usually formed by cutting individual stacks of bags with a steel edged die which causes small tears or nicks to be formed along the mouth edge portion of the bag. Obviously, with such nicks, tear initiation is promoted when any stress is placed upon the open bag handles.

Figure 5:
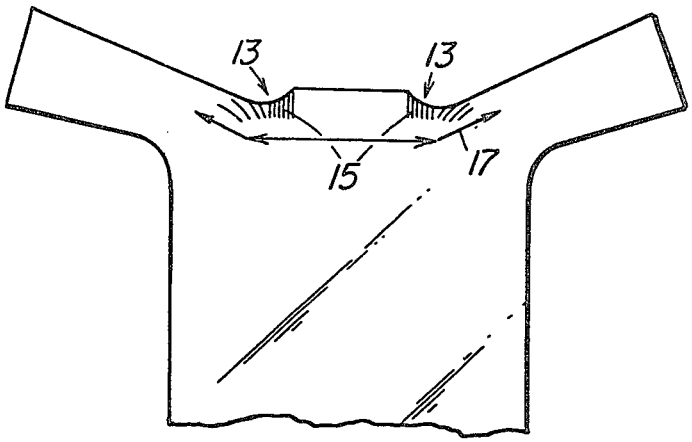
FIG. 5 is a schematic illustration of the bag structure of the present invention when opening forces are applied thereto.

A clearer understanding of the present invention may be had by reference to the accompanying drawings. FIGS. 1 and 2 show a typical prior art handle bag, generally designated as 10, both in a lay flat and partially opened position. As shown in FIGS. 1 and 2 such prior art bag structures include inwardly folded side edge gussets 12. After the bag is formed from a continuously running gusseted tube, seals are made to form the bag bottom and upper edge portion 14. After forming the sealed tube, a generally U shaped cut out portion is cut away from the bag tube thereby forming an open mouth having handles 11 adjacent opposite edges of the mouth. In the area 13, located at the base of the opposite handles and inboard of the bag edge, severe stresses are encountered during bag loading operations when the bag is positioned as shown in FIG. 5. This will be discussed more fully hereinafter.

To relieve such stresses applicant has found that pleats 15, when formed in the area of maximum stress encountered during the loading operation, either eliminate or substantially reduces the tendency of the bag to tear along its length when placed under such stresses. As shown in FIG. 3, pleats 15 may extend entirely across the bag mouth edge and slightly beyond or alternatively, as shown in FIG. 4, such pleats 15 may be positioned in spaced apart locations which generally correspond to areas 13. The individual bags, shown in FIGS. 3 and 4, vary somewhat in the configuration of the mouth cut out portion. It will be noted, for example, that the bag of FIG. 4 is provided with a tab 16 which may be employed to suspend a pack of such bags prior to use. Pleats 15 may be formed utilizing a convenient method such as for example impressing a flattened bag between matched metal rollers 20, 21 or plates during the bag forming operation. The rollers 20, 21 or plates are provided with peaks 22, 24, which may be truncated 23, 25, together with mating recesses in an opposing plate or roller 20, 21. Enlarged cross-sections of two forms of pleat configurations are shown in FIGS. 4A and 7. In specific examples discussed hereinafter, it was found that an individual pleat length of about 0.75 up to about 1 inch was effective, i.e., the linear extent of the pleat from the bag mouth edge to its termination in the wall of the bag mouth.

When the bag structures, examples of which are shown in FIGS. 3 and 4, are suspended from a loading fixture and are being loaded, the maximum stresses encountered now occur in an area below the cut edge of the bag mouth. As illustrated in FIG. 5 these stress areas are now positioned and are distributed generally as shown by vectors 17. Any convenient and conventional technique for inspecting stress areas in a thermoplastic bag may be employed such as viewing such a bag while under stress conditions through a pair of crossed polarized plates. It will be seen from FIG. 5 that, by virtue of the pleated configuration of the bag edges of the present invention, maximum stress forces are no longer located along the edge of the cut out mouth portion of the bag and accordingly are now removed from the most susceptible tear area 13.

Figure 6:
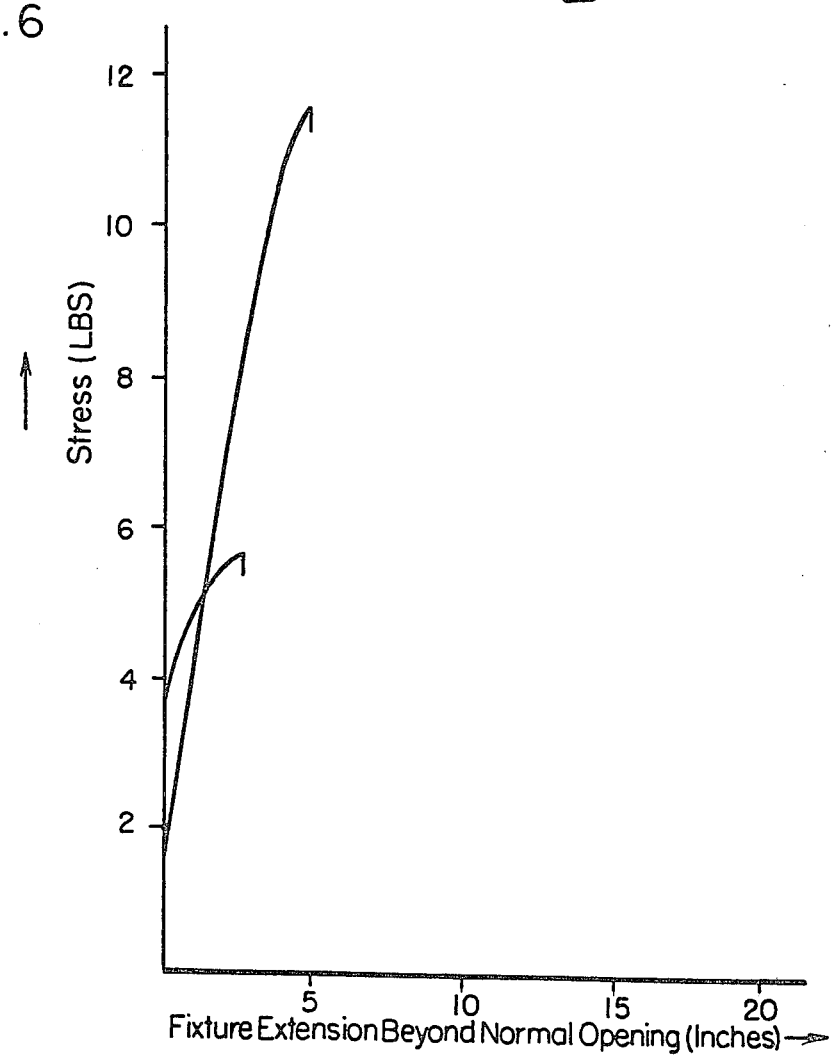
FIG. 6 is a graphic representation illustrating the improved resistance to applied stress of the bag structures of the present invention.

FIG. 6 represents a graphic illustration of the improved tear resistance of the bag structure of the invention. In one instance, as shown in FIG. 6, handle bag structures were fabricated from high density polyethylene having a thickness of about 1.0 mil. Such bags were structurally similar to the bags shown in FIG. 2, however no pleats were formed in the bags. To determine tear susceptibility in a controlled test, a $\frac{1}{8}$ inch deep notch was cut in the machine direction in the cutout regions of each bag $\frac{1}{8}$ inch from the gusset fold as indicated by the arrows in FIG. 4. Subsequently the bag was opened and the opposite handle loops 11 were spread apart and draped over a pair of bag retaining fixtures which were positioned on opposed jaws of an Instron tensile tester. Next, the jaw carrying the load cell and one handle loop was gradually raised until the bag failed as a result of a machine direction tear of the film. Such bags failed by tearing in the machine direction at applied stress forces of below about 6 pounds as shown in FIG. 6. The tears invariably occurred at the notched cut formed in the bag prior to the test.

The graph coordinates shown in FIG. 6 plot the extension or the amount of jaw separation of the Instron in inches against the stress measured in pounds to bag failure. It will be obvious upon inspection of FIG. 6 that when bags are formed from a 1.0 mil high density polyethylene resin and when such bags do not have the pleat structure of the present invention in area 13, bag failure occurs at a value of less than 6 pounds of stress. Conversely, when the pleated bag structures of the present invention are tested, i.e., a bag having a thickness of about 1.0 mil fabricated from high density polyethylene having an identical cutout region and having pleats therein in the area designated as 13 on the drawings, such structures will withstand applied stresses of almost up to 12 pounds.

What is claimed is:

1. A thermoplastic bag structure having front and rear walls, a pair of spaced upwardly extending handle members formed integrally with said front and rear walls, an open mouth portion between said handles, and a plurality of upwardly extending pleats formed in said front and rear walls, said pleats being located at least transverse the lower inner portion of each of said handle members and said mouth portions immediately adjacent said lower inner portions of said handle members.

2. A thermoplastic bag structure in accordance with claim 1, wherein said bag is fabricated from a polyolefin thermoplastic.

3. A thermoplastic bag structure in accordance with claim 2, wherein said polyolefin is selected from the group consisting of polyethylene, polypropylene, polybutene and copolymers and blends thereof.

4. A thermoplastic bag structure in accordance with claim 2, wherein said polyolefin is high density polyethylene having a film density in the range of from about 0.935 up to about 0.965.

5. A thermoplastic bag structure in accordance with claim 1, wherein said pleats extend transverse said mouth portion.

6. A thermoplastic bag structure in accordance with claim 1, wherein said pleats extend downwardly from said mouth portion a distance in the range of about 0.5 inch to about 1.0 inch.

7. In a thermoplastic bag structure comprising uniform front and rear bag walls and an open mouth top portion, wherein the open mouth portion is characterized by having a pair of integrally formed carrying handles which are located on opposite ends of the mouth portion, and wherein the mouth portion and handles are formed by a U-shaped cut-out; the improvement which comprises:

a plurality of pleats formed in the front and rear walls adjacent the bag mouth and a lower inner portion of the carrying handles, permitting lateral expansion which avoids edge stress concentration in the area of the pleats and thereby decreasing tear propagation.

8. A thermoplastic bag structure according to claim 7, wherein said pleats are vertically aligned with the bag mouth.

9. A thermoplastic bag structure according to claim 7, wherein said pleats extend transverse to the mouth portion.

10. A thermoplastic bag structure according to claim 7, wherein the thermoplastic comprises polyolefin.

11. A thermoplastic bag structure according to claim 7, wherein said thermoplastic comprises high density polyethylene.

* * * * *